United States Patent [19]

Douglas

[11] 4,414,706

[45] Nov. 15, 1983

[54] FRICTION STAY WITH RESILIENT COUPLING FOR WINDOWS

[75] Inventor: Jack E. Douglas, Walsall, England

[73] Assignee: Arthur Shaw Manufacturing Company, Willenhall, England

[21] Appl. No.: 300,395

[22] Filed: Sep. 8, 1981

[30] Foreign Application Priority Data

Sep. 23, 1980 [GB] United Kingdom ..... 8030702

[51] Int. Cl.[3] ..... E05D 15/32

[52] U.S. Cl. ..... 16/370; 49/248; 403/341; 403/388

[58] Field of Search ..... 16/365, 366, 368, 370, 16/387, DIG. 13; 403/341, 388; 49/246, 248

[56] References Cited

U.S. PATENT DOCUMENTS

| | | | |
|---|---|---|---|
| 2,516,196 | 7/1950 | Fowler | 16/368 X |
| 2,781,560 | 2/1957 | Ziesmer | 16/370 X |
| 4,226,002 | 10/1980 | Davis | 49/248 X |

*Primary Examiner*—Fred Silverberg
*Attorney, Agent, or Firm*—Larson & Taylor

[57] ABSTRACT

A friction stay for a window has mounting plates 1,3 for connection to the window frame and sash (not shown) with the plates being connected by pivotal arms 5,8. There is provided a coupling 13 in one arm which connects two link parts 11 and 12 of the arm together. The coupling 13 includes two resilient elements 16,17 which are arranged to be compressed under loads applied longitudinally of the arm on pivotal movement of the stay in use. The elements 16,17 effectively store energy and release this on folding of the stay to apply a pull-in force to the sash to hold it closed to the frame. The coupling 13 includes a connector plate 14 which by a rivet 22 couples and locates the ends of the link parts 11,12 together for relative movement with the resilient elements 16,17 being interposed between the plate 14 and opposed link parts. Other forms of resilient coupling are described in further embodiments.

8 Claims, 4 Drawing Figures

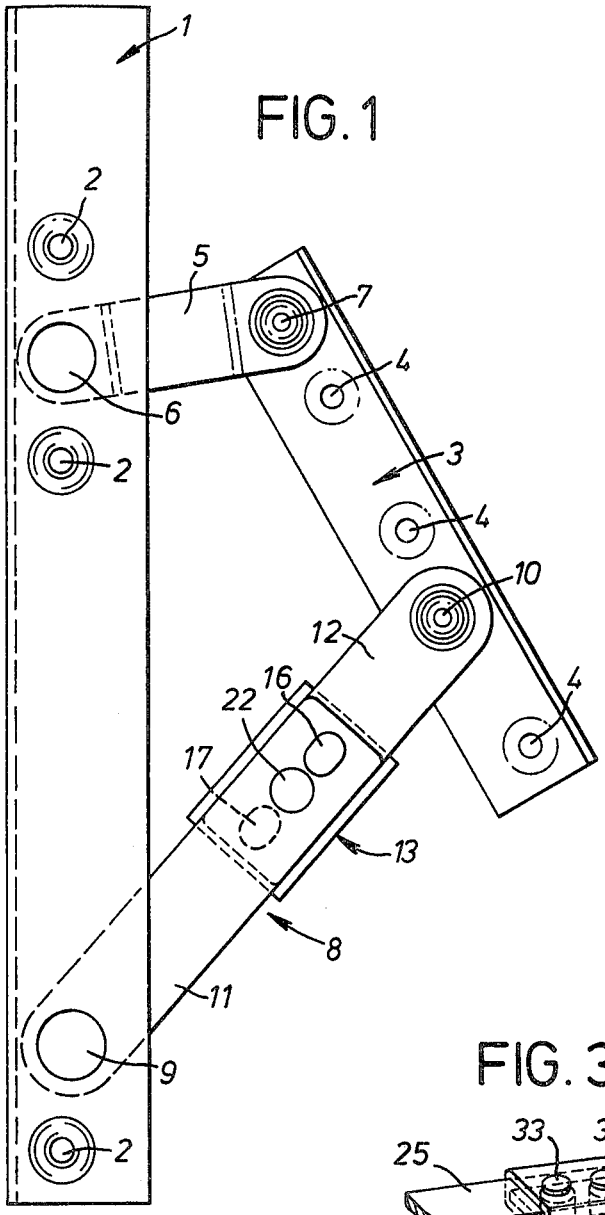
FIG. 1
FIG. 3
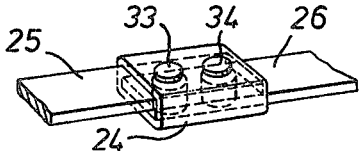

FRICTION STAY WITH RESILIENT COUPLING FOR WINDOWS

BACKGROUND OF THE INVENTION:

This invention concerns stays for windows and relates to stays of the kind comprising one or more arms or links and/or mounting plates that are connected together by one or more friction pivot joints which permit restrained pivotal movement of the stay parts, the stay being adapted and arranged for mounting on a sash and securing to the associated frame so that the sash is supported for frictionally restrained pivotal movement on and relative to the frame.

The stays of the kind aforementioned are conventionally used in pairs, one either side of the sash and associated frame. The sash may be hung on the stays for top, bottom or side opening, and the frictional restraint is provided by the design and manufacture of the pivot joints. For instance, a known form of pivot joint comprises a rivet which is clinched to exert a pressure within the joint to generate the frictional restraint.

In use of the stays of this kind, the arms or links are arranged to fold over one another and these lie in superposed relationship within the rebate of the frame when the sash is closed. In order to ensure that the sash closes to and fits within the rebate in a substantially weather proof manner, it is important that the stays be designed to bring the sash properly to the closed position, and to hold the sash in the closed position irrespective of additional fasteners that might be provided. One way of achieving this that has been employed previously is to design the stay so that one or more of the arms or links is stressed when the stay is folded and such stress is translated into forces acting on the stay to bias the sash in a direction towards the frame. This bias is referred to as "pull-in".

The amount of stress applied to the arms or links for adequate pull-in is designed by close control of distances between pivot centres and the lengths of the arms or links so that in the stressed condition at least one arm or link is induced in the closing position to bow or to flex. The flexure of the arm or link effectively produces a force acting on the sash to produce the desired pull-in.

In manufacture of such stays the precise control of the distances is difficult to maintain having regard to the different characteristics of the material used for the arms and/or links and the nature of the riveted pivot joint wherein slight variations in rivet sizes, clearance holes and clinching pressures and alignment can arise. Furthermore, it will be appreciated that the amount of flexing intended to be imparted to the arm or link is itself restricted by: the material used for the arm or link, this usually being aluminium; the clearances provided within the rebate in which the bowed arm or link is confined when the sash is closing or closed; and lastly, the strength of the pivot joint including the rivet which is highly stressed to maintain the frictional restraint in service.

SUMMARY OF THE INVENTION:

According to this invention, we provide a window stay for pivotally mounting a sash on a frame, the stay comprising one or more arms or links and mounting plates that are connected together by one or more friction pivot joints which permit restrained pivotal movement of the stay parts, and wherein at least one of the stay arms comprises a resilient element arranged to be compressed under load applied longitudinally of the arm on pivotal movement of the stay arm and the resilient element being arranged to store energy and to apply such stored energy on resilient restoration to the arm of the stay to provide a pull-in force acting on the sash when the stay is fitted to the sash and frame.

Preferably the stay arm comprising the resilient element is pivotally connected to respective mounting plates by friction pivot joints including a rivet which is clinched to impart the frictional restraint within the pivot joint. The stay arm is stressed during pivotal movement but instead of the material of the arm being forced to bend or bow with high forces being transmitted to the rivet, the resilient element incorporated in the stay arm is deformed resiliently thus absorbing the energy for later application to the sash through the stay arm. Such an arrangement provides an improved distribution of forces and permits materials to be selected for the stay arm without need for designing for the flexing and bowing of the stay arm and providing a special material therefor. Additionally, bending and stress loads on the pivot joint are significantly reduced.

Conveniently the resilient element can be incorporated in the stay arm by providing the stay arm with a coupling including the resilient element. The coupling may be arranged so that the stay arm has two links each being adapted to engage the resilient element so as to apply forces thereto and to be acted on by the restoration forces.

If desired more than one resilient element may be provided, for instance a resilient element for engagement with one link of the stay arm and another resilient element for engagement by the other link of the stay arm. The two stay links may be coupled together by a connector in which the resilient element or elements is/are located with the connector locating the two links co-axially.

The material of the resilient element(s) is preferably a plastics material which is resiliently deformable and which has low friction properties to reduce any tendency for sticking or jamming.

The invention will now be described with reference to exemplary embodiments depicted in the accompanying drawings.

BRIEF DESCRIPTION OF THE DRAWINGS:

FIG. 1 is a front view of a window stay according to this invention;

FIG. 3 is a perspective view of an alternative stay arm coupling; and

Figure 2:
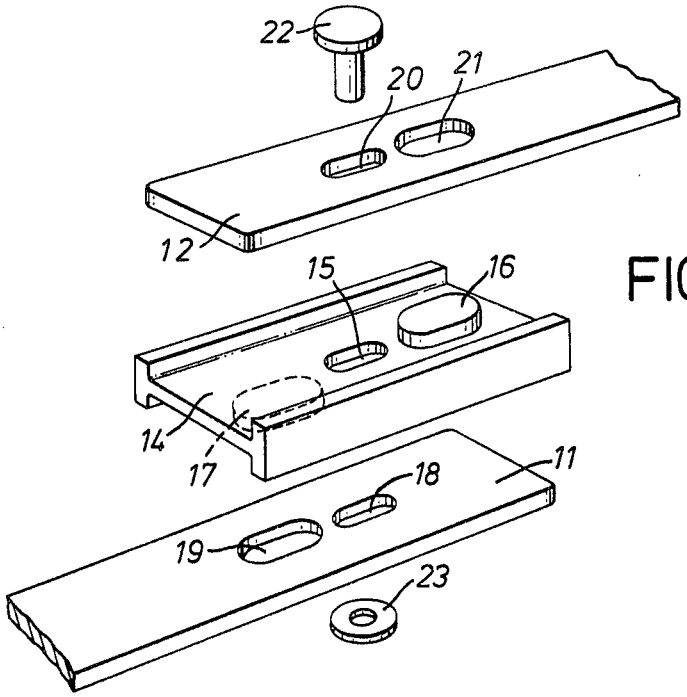
FIG. 2 is an exploded detail view of the stay arm coupling of the stay shown in FIG. 1.

DETAILED DESCRIPTION OF THE PREFERRED EMBODIMENTS:

With reference to FIGS. 1 and 2 of the drawings, the window stay comprises a mounting plate 1 adapted by means of holes 2 to be secured by suitable screws to a fixed frame of the window (not shown). There is a sash plate 3 adapted by means of holes 4 to be secured by suitable screws to the sash of the window (not shown).

A short cranked arm 5 is connected to the plates 1 and 3 by respective friction rivets 6,7 which provide frictionally restrained pivotal movement. Another stay arm 8 longer than the cranked arm 5 is connected to the plates 1 and 2 by further friction rivets 9,10 respectively.

In known manner, two such window stays would be provided for supporting a sash on a frame, one window stay on each of two opposed sides of the sash/frame. The sash may be hung for horizontal or vertical pivotal movement. The window stay is depicted in FIG. 1 in the open position in which, in use, the sash would be pivotted outwardly from the frame and held in that position by the frictional restraint in the pivot joints provided by the friction rivets 6, 7, 9 and 10. In closing the sash, the sash plate 3 moves towards the mounting plate 1 and the arms 5 and 8 pivot so that in the closed position (not shown) the sash plate 3 overlies the mounting plate 1 with the folded arms 5 and 8 therebetween. The window stay so folded is concealed within a rebate between the sash and the frame.

In order to ensure that the sash is held in the closed position a force is required to be applied to the sash through the stay arms and previously this has been achieved by providing pivot centres which are designed to stress at least one stay arm on closing movement so that the arm bows and at the closing position this stress is translated to a force applied to the sash. This arrangement presents many problems and disadvantages.

According to this invention the stay arm 8 comprises two links 11 and 12 which are connected at their adjacent ends by a coupling 13 arranged to store energy through resilient elements.

With reference to FIG. 2, the coupling 13 comprises an I-section connector plate 14 which has a central elongate slot 15 and two oppositely directed blocks 16,17 that are axially spaced from the slot 15. The blocks 16,17 are made of a suitable material, such as a grade of the plastic nylon or an acetal resin which is suitable and capable of resilient deformation. The connector plate 14 may be an injection moulding.

The link 11 has one end underlying the connector plate 14 with the sides of the link 11 being located by the side flanges of the connector plate. The end of the link 11 is provided with a slot 18 and a recess 19. Similarly the link 12 overlies the connector plate 14 and has a slot 20 and a recess 21. The two links 11 and 12 and the connector plate 14 are coupled together by a rivet 22 which extends through the slots 20, 15 and 18. A washer 23 is received on the tail of the rivet protruding to the underside of the link 11 and the rivet tail is clinched to hold the assembly in a manner to permit limited sliding movement of the links 11,12 relative to the connector plate 14. Preferably, the rivet 22 is coated with a plastics material and so is the washer 23.

Each block 16,17 of the connector plate is received in the respective complementary rebate 21,19 in the links 12,11. The blocks 16,17 are an interference fit so that when the stay arm 13 is in the extended open position as depicted in FIG. 1, the stay arm 13 is substantially rigid.

On folding movement of the stay, due to the designed position of the pivot centres, the stay arm 8 is stressed so as to be subject to axial compressive load. Such load is applied to the resilient blocks 16,17 which are compressed axially and thus store the energy. Such compression can occur due to the limited freedom of the two links to move relatively. As the folding movement concludes, the energy stored in the resilient blocks 16,17 is applied through the stay arm 13 to the sash to provide the characteristic called "pull-in".

Accordingly, as the blocks 16,17 are resiliently deformable the links 11,12 are not required to bow or bend under stress and loads on the friction pivot rivets are equalised through the connector 13. This provides several advantages as the material of the links 11,12 can be selected without regard to it's "spring" characteristics and stresses on the rivet head and tail of the friction rivets 9 and 10 are obviated.

Although in this embodiment the connector plate 14 has integral blocks 16,17, the blocks may be separate and the connector plate may be of metal with the blocks 16,17 retained by suitable fitting, for instance by providing a groove around each block for seating on the marginal edge of a complementary hole or recess formed in the connector plate. Furthermore, the two blocks can comprise a separate resilient member for connection to a connector plate with the resilient member having an opening or slot through which the coupling rivet extends.

The arm 5 need not be cranked and clearance for folding movement of the arm relative to the mounting plates 1,3 can be provided by having raised bosses on the two mounting plates.

Figure 4:
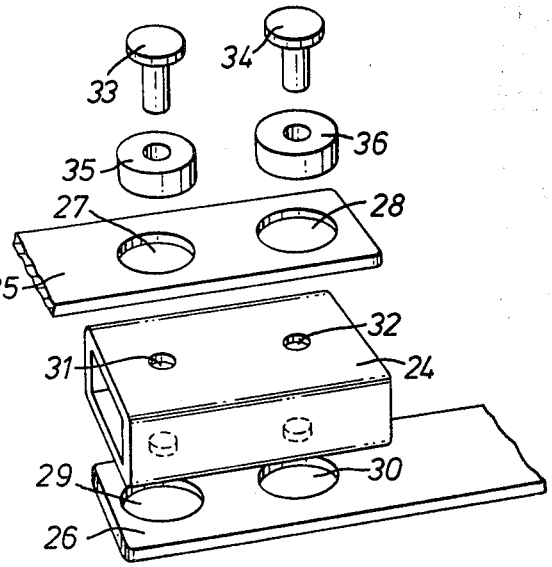
FIG. 4 is an exploded detail view of the stay arm coupling shown in FIG. 3.

With reference to the embodiment depicted in FIGS. 3 and 4, an alternative form of connector is shown.

In this alternative, there is a hollow connector 24 of rectangular section in which opposed ends of two links 25,26 are received. The end of link 25 has two axially spaced apart circular holes 27,28 and the end of the other link 26 has two similar holes 29,30. The connector 24 has two through bores 31,32 through each of which one of a pair of rivets 33,34 is arranged to extend. Each rivet shank carries a resiliently deformable plastics bushing 35,36. Each bushing 35,36 is seated in the respective aligned holes 27,29 and 28,30 of the links 25,26 so that the bushings provide resiliently deformable elements in the connector.

The rivets are clinched to hold the connector assembly together whilst permitting relative movement between the two links. The rivets may be coated with a plastics material.

As previously described with reference to the first embodiment, on folding movement of the stay, the bushings are subjected to compressive loads and deform to store energy. On final closing movement, such stored energy is applied to the sash through the stay arm.

In a modification of the connector of FIGS. 3 and 4, particularly suitable for certain applications, only one resiliently deformable bushing may be provided with a single rivet coupling the two links together through the connector in a manner similar to that previously described. It is also considered that more than two bushings may be provided by a similar arrangement.

It is envisaged that for certain special applications of window stays, the connector could be arranged for uncoupling the two links, for instance to permit the sash to be reversed. Such uncoupling could be achieved by providing releasable fastenings instead of the rivets as described.

What is claimed is:

1. In a friction window stay for pivotally mounting a sash on a frame, said stay comprises arms pivotally connected to respective sash and window frame mounting plates by friction pivot joints so as to permit restrained pivotal movement of said arms relative to said mounting plates; one of said stay arms comprises two links connected together by a resilient coupling for compression under load applied longitudinally of said one stay arm to store energy and to apply such stored energy to said one stay arm on resilient restoration, said resilient coupling comprising a connector locating said links co-axially for relative movement with at least one resilient element acting between said connector and said links.

2. The friction stay according to claim 1 wherein said coupling comprises two of said resilient elements which are spaced apart longitudinally of said one stay arm.

3. The friction stay according to claim 2 wherein each said resilient element comprises a block of resiliently deformable plastics material.

4. The friction stay according to claim 3 wherein said connector is connected to said links for relative axial movement by at least one rivet extending through said connector and adjacent ends of said links.

5. The friction stay according to claim 4 wherein said connector comprises a plate having an elongate slot through which said rivet extends and said two resilient elements are mounted on said plate on opposed sides of said slot and on opposed faces of said plate.

6. The friction stay according to claim 5 wherein said resilient elements are blocks of elongate form located in recesses formed in respective one of said links and said plate.

7. The friction stay according to claim 4 wherein said connector comprises a hollow connector in which adjacent ends of said two links are received for relative movement with said links being coupled to said connector by two axially spaced rivets extending through said connector and said ends of said two links.

8. The friction stay according to claim 7 wherein said resilient elements comprise bushings mounted on said rivets and received in respective recesses in each said end of said two links.

* * * * *